US006641902B1

(12) United States Patent
Kobayashi et al.

(10) Patent No.: US 6,641,902 B1
(45) Date of Patent: Nov. 4, 2003

(54) NONWOVEN FABRIC AND PROCESS FOR MAKING THE SAME

(75) Inventors: Toshio Kobayashi, Kagawa-ken (JP); Hideyuki Ishikawa, Kagawa-ken (JP); Satoshi Mitsuno, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 78 days.

(21) Appl. No.: 09/523,801

(22) Filed: Mar. 13, 2000

(30) Foreign Application Priority Data

Mar. 18, 1999 (JP) ..... 11-074206

(51) Int. Cl.[7] ..... B32B 7/02; D04H 1/00; D04H 13/00; D04H 3/00; D04H 5/00

(52) U.S. Cl. ..... 428/220; 428/195; 428/198; 428/219; 442/327; 442/334; 442/366; 442/402; 442/408

(58) Field of Search ..... 428/198, 195, 428/219, 220; 442/327, 366, 402, 408, 334

(56) References Cited

U.S. PATENT DOCUMENTS

| | | | | | |
|---|---|---|---|---|---|
| 3,688,355 | A | | 9/1972 | Okzaki et al. | |
| 4,041,203 | A | * | 8/1977 | Brock et al. | 428/157 |
| 4,276,681 | A | | 7/1981 | Marshall | |
| 4,436,780 | A | * | 3/1984 | Hotchkiss et al. | 428/198 |
| 5,614,281 | A | * | 3/1997 | Jackson et al. | 428/100 |
| 5,618,610 | A | * | 4/1997 | Tomita et al. | 428/152 |

FOREIGN PATENT DOCUMENTS

| | | | |
|---|---|---|---|
| EP | 0084963 | A | 8/1983 |
| EP | 0468799 | A | 1/1992 |
| EP | 0625602 | A | 11/1994 |
| EP | 0705933 | A | 4/1996 |
| EP | 0945536 | A | 9/1999 |
| FR | 2209003 | A | 6/1974 |
| FR | 2265891 | A | 10/1975 |
| FR | 2601970 | A | 1/1988 |
| JP | 8-60509 | | 3/1996 |

OTHER PUBLICATIONS

Copy of European Search Report dated Jul. 4, 2000.

* cited by examiner

*Primary Examiner*—Elizabeth M. Cole
*Assistant Examiner*—Norca L. Torres
(74) *Attorney, Agent, or Firm*—Butzel Long

(57) ABSTRACT

A nonwoven fabric is formed with, in addition to crests of high fibers surface density and troughs of low fibers surface density extending in parallel one to another in one direction, bridge-like regions each extending transversely of this one direction between pair of the crest and the trough adjoining each other, and thereby enables a direction dependency of tensile strength and stretchability to be effectively alleviated.

5 Claims, 3 Drawing Sheets

FIG. I

NONWOVEN FABRIC AND PROCESS FOR MAKING THE SAME

BACKGROUND OF THE INVENTION

This invention relates to a nonwoven fabric and more particularly to a nonwoven fabric presenting no significant strength difference between in its machine direction (MD) and in its direction (CD) intersecting the machine direction and provided on its surface with a plurality of irregularities. This invention relates also to a process for making such a nonwoven fabric.

Japanese Patent Application Disclosure No. 1996-60509 describes a process for making a nonwoven fabric used as a wiper. According to this known process, a laminate consisting of a hydrophilic web and a hydrophobic web is continuously fed in one direction and the laminate is, as it is fed, subjected to high pressure water streams injected from fine orifice nozzles. In this manner, component fibers of the hydrophilic web and the hydrophobic web are rearranged and mechanically intertwined together to form a nonwoven fabric. This nonwoven fabric is then subjected to a heat treatment in order to crimp composite fibers contained in the web and thereby to form a plurality of irregularities on the surface of the nonwoven fabric. When this nonwoven fabric is used as a wiper, these irregularities formed in this manner function to scratch off dust and dirt from an object which should be cleaned.

As the nonwoven fabric obtained by subjecting the laminated web continuously fed in one direction to the high pressure columnar water streams, many of the component fibers lying immediately below the columnar water streams are forcibly moved aside. As a result, trough-like regions are defined by the component fibers of its surface density reduced by the moved aside fibers and crest-like regions are defined by the component fibers of its surface density increased by accumulated fibers. These trough- and crest-like regions extend in the web feed direction and are alternately arranged transversely of the web. Such a process is well known to those skilled in the art. It is also well known that such nonwoven fabric has a relatively high tensile strength and a relatively low stretchability in the MD but a relatively low tensile strength and a relatively high stretchability in the CD. In other words, the tensile strength as well as the stretchability of this nonwoven fabric largely depend on the direction. Accordingly, when it is desired to use this nonwoven fabric as the wiper, its orientation must be considered to avoid a possibility that the nonwoven fabric might be easily torn.

SUMMARY OF THE INVENTION

An object of this invention is to provide a nonwoven fabric requiring no consideration of its orientation to ensure the desired tensile strength as well as the desired stretchability and a process for making such a nonwoven fabric.

This invention aiming to achieve the object set forth above comprises a first invention relating to the nonwoven fabric and a second invention relating to the process for making this nonwoven fabric.

According to this first invention, there is provided a nonwoven fabric having first and second surfaces extending in parallel to each other and formed by component fibers mechanically entangled between the first and second surfaces, regions of high fibers surface density and regions of low fibers surface density continuously or intermittently extend in parallel one to another in one direction so as to be alternately arranged in a direction transversely of the one direction and to form undulations defined by crests corresponding to the regions of high fibers surface density and troughs corresponding to the regions of low fibers surface density; and the nonwoven fabric further including bridge-like regions each extending transversely of the one direction between each pair of adjacent the region of high fibers surface density and the region of low fibers surface density and having a density higher than that in the region of low fibers surface density.

According to one embodiment of this first invention, the region of low fibers surface density has a width of 0.05–0.5 mm as measured transversely of the one direction.

According to another embodiment of this first invention, the component fibers partially extend transversely of the one direction.

According to still another embodiment of this first invention, the component fibers are short fibers or continuous fibers.

According to this second invention, there is provided a process for making a nonwoven fabric comprising the steps as follow:

a. a step of continuously feeding a fibrous web in one direction;

b. a step of feeding the fibrous web to a region lying immediately below high pressure columnar water streams injected from a plurality of nozzles arranged on a line extending transversely of the web at a range of feed rate deceleration of 16–35% as defined by a formula:

Feed velocity deceleration (%)={(Feed velocity in front of columnar water streams)−(Take-out velocity behind columnar water streams)}/(Take-out velocity behind columnar water streams)×100; and c. a step of taking-out the web having been treated by the columnar water streams in the one direction at the range of feed velocity deceleration.

According to one embodiment of this second invention, the columnar water streams are obliquely injected toward the web in the direction opposed to the web feed direction at an angle of 4~15° with respect to a perpendicular line to the web.

According to another embodiment of this second invention, the fibrous web comprises short fibers or continuous fibers.

DETAILED DESCRIPTION OF THE PREFERRED EMBODIMENTS

Details of a nonwoven fabric according to this invention and a process for making the same will be more fully understood from the description given hereunder with reference to the accompanying drawings.

Figure 1:
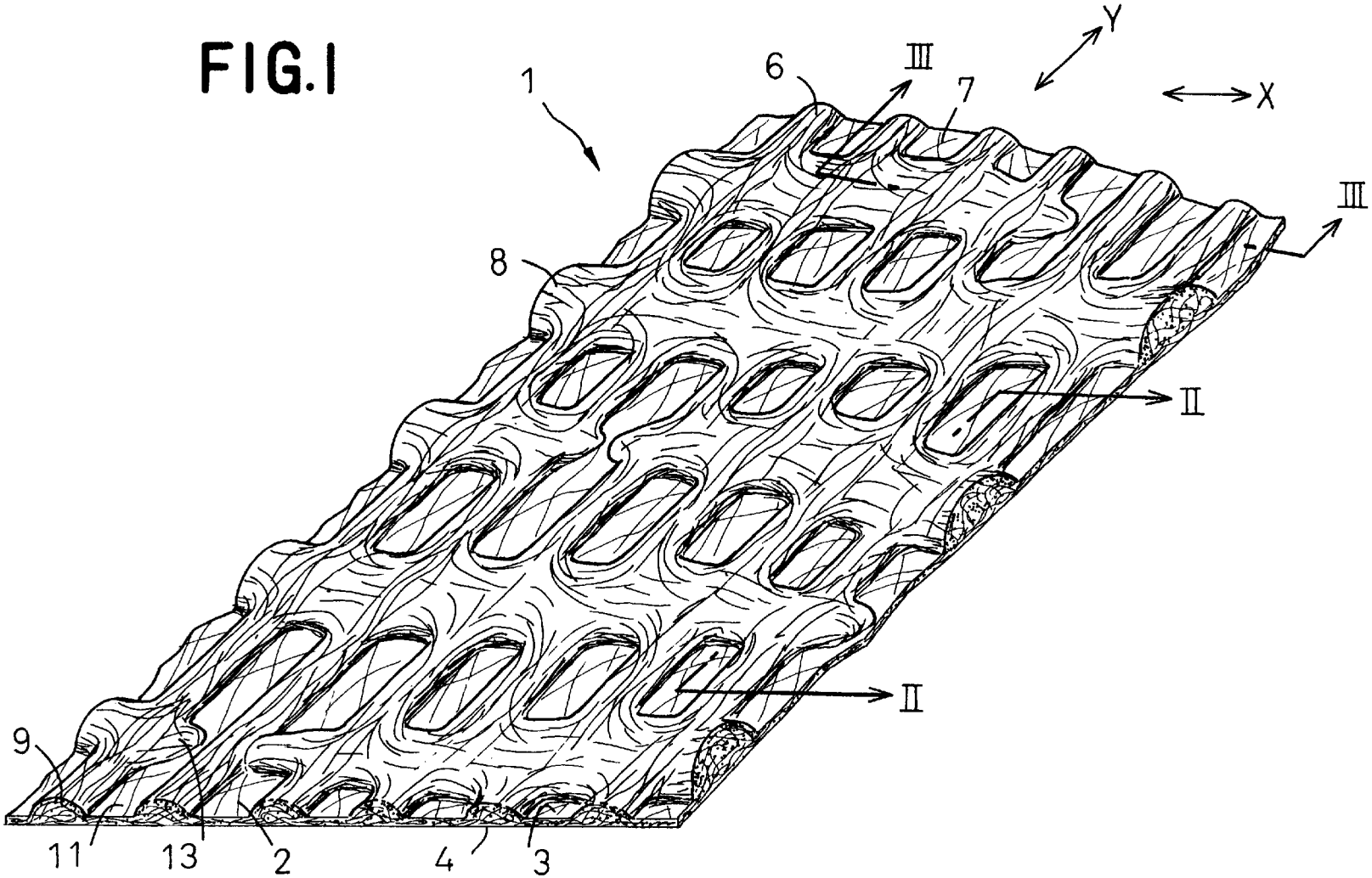
FIG. 1 is a perspective view of a nonwoven fabric according to this invention.
Figure 2:
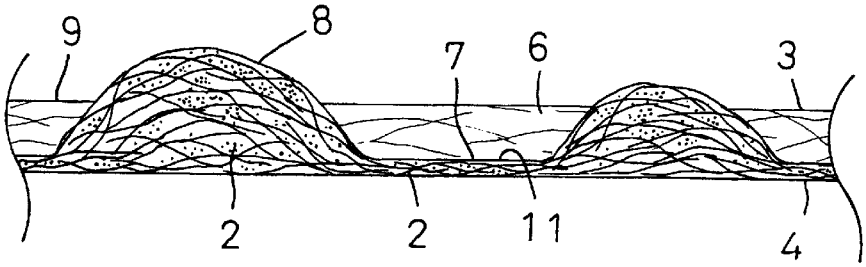
FIG. 2 is a sectional view taken along a line II—II in FIG. 1.
Figure 3:
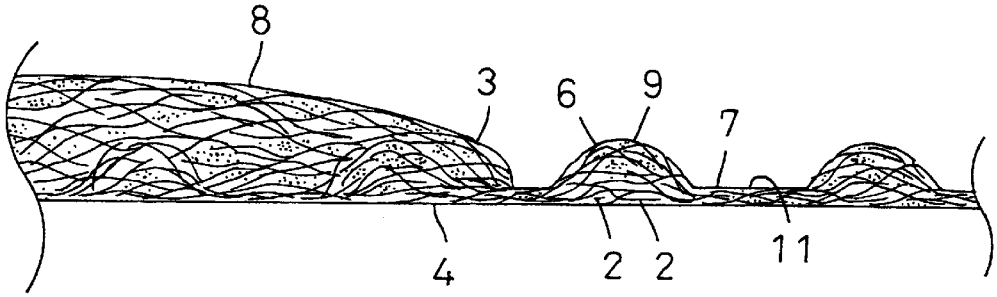
FIG. 3 is a sectional view taken along a line III—III in FIG. 1.

FIG. 1 is a perspective view of a nonwoven fabric according to this invention, FIG. 2 is a sectional view taken along a line II—II and FIG. 3 is a sectional view taken along a line III—III in FIG. 1. The nonwoven fabric 1 formed by mechanically entangled component fibers 2 is defined by its upper surface 3 which has significant irregularities and its lower surface 4 which is less irregular than the upper surface 3 i.e., rather smooth. The nonwoven fabric 1 includes regions 6 of a high fibers surface density (high density regions) and regions 7 of a low fibers surface density (low density regions) which are alternately arranged in a direction as indicated by a double-headed arrow X and extend substantially in parallel one to another transversely of the direction X as indicated by a double-headed arrow Y. The nonwoven fabric 1 further includes bridge-like regions each extending in the direction as indicated by the double-headed arrow X between at least every pair of adjacent the regions 6, 7 and presenting a fibers surface density higher than that of the low density regions 7. The term "fibers surface density" used herein (referred to hereinafter simply as "surface density") means the number of component fibers present in a planar unit area as viewed from the upper surface 3 toward the lower surface 4 of the nonwoven fabric 1.

The component fibers 2 may be thermoplastic synthetic fibers, natural fibers such as pulp fibers, chemical fibers such as rayon fibers or a mixture of these fibers in a basis weight of 20~200 g/m$^2$. The synthetic fibers would preferably have a fineness of 0.1~3 deniers and could be hydrophilicized if desired.

In the high density regions, the fibers 2 lying in the vicinity of the upper surface 3 are oriented substantially in the direction Y. The high density regions 6 include much more fibers 2 accumulated therein than in the low density regions 7 and correspondingly have a thickness larger than the low density regions 7. Accordingly, apices of the respective high density regions 6 lie at a level higher than apices of the low density regions 7. Each of the high density regions 6 preferably has a width of approximately 0.05~5 mm as measured in the direction X and the maximum thickness of approximately 0.2~1 mm.

In the low density regions 7, the fibers 2 may be oriented substantially in the direction Y or not oriented in any particular direction. The low density regions 7 are not so crowded with the fibers 2 as the high density regions 6 and have the minimum thickness at their bottoms 11. Each of the low density regions 7 preferably has a width of approximately 0.02~0.5 mm as measured in the direction x and a thickness of approximately 0.02~0.5 mm as measured at its bottom 11. The high density regions 6 and the low density regions 7 are alternately arranged to form undulations in the direction X and thereby to define the crests and the troughs. The low density regions 7 have a tensile strength lower than that of the high tensile strength regions 6 and a stretchability higher than that of the high density regions 6 in the both directions X, Y.

Each of the bridge-like regions 8 extend in the direction X between each pair of the high density region 6 and the low density region 7 adjoining each other substantially at right angles or obliquely. An apex of the bridge-like region 8 lies at substantially the same level corresponding to or higher than the apex 9 of the high density region 6. However, it should be understood that the bridge-like region 8 may be lower than the apex 9 of the high density region 6 in the vicinity of opposite ends of the bridge-like region 8. While not specified, the bridge-like region 8 may be formed, for example, to have a width in the order of 0.5~1 mm, a length in the order of 5~100 mm and a pitch in the order of 1~3 mm at which the bridge-like region 8 are repeated in the direction Y. The component fibers 2 of the bridge-like region 8 may partially be oriented in the direction X. These fibers 2 extend between the bridge-like region 8 and the high density region 6 as well as between the bridge-like region 8 and the low density region 7 so that these regions 6, 7, 8 may be integrally connected together. Fibers surface density of the bridge-like region 8 may be similar to or higher than that of the low density region 7 and even higher than that of the high density region 6. When the nonwoven fabric 1 is observed as a whole, the bridge-like regions 8 appear as wrinkles formed on the upper surface 3 or on both the upper surface 3 and the lower surface 4 of the nonwoven fabric 1.

It is assumed that the nonwoven fabric 1 comprises the high density regions 6 and the low density regions 7 but none of the bridge-like regions as included in the nonwoven fabric of FIG. 1 as the important regions. Such nonwoven fabric will be easily stretched and torn particularly in the low density regions 7 as the nonwoven fabric is pulled in the direction X. On the other hand, if the nonwoven fabric is pulled in the direction Y, the presence of the high density regions 6 prevents the nonwoven fabric from being easily stretched and torn as it occurs when the nonwoven fabric is pulled in the direction X.

According to this invention, such nonwoven fabric having the strength and the stretchability largely depending on whether the nonwoven fabric is pulled in the direction X or in the direction Y, i.e., the remarkably direction-dependent nonwoven fabric is added with the bridge-like regions 8. The presence of these bridge-like regions function to reduce the stretchability and to improve the tensile strength of the low density regions 7. In this manner, the difference in the tensile strength as well as in the stretchability depending on whether the nonwoven fabric is pulled in the direction X or in the direction Y can be reduced and thus the homogeneous nonwoven fabric substantially free from the direction-dependency can be obtained.

When the nonwoven fabric 1 obtained in this manner is used as the wiper to wipe out dust and dirt, for example, from wall by scrubbing the wall in the direction Y, the bridge-like regions 8 can scrap off the dust and dirt from the wall. The thickness difference between the high density regions 6 and the low density regions 7 to define remarkable level difference serves also to scrap off the dust and dirt by scrubbing the wall with the nonwoven fabric 1 in the direction X. Furthermore, this nonwoven fabric 1 is homogeneous and therefore there is no remarkable difference in the tensile strength and the stretchability depending on whether the nonwoven fabric 1 is pulled in the direction X or in the direction Y. Accordingly, the user can scrub the wall without being nervous about an apprehensive rupture of the nonwoven fabric 1 by moving the nonwoven fabric 1 either in the direction X or in the direction Y.

If the component fibers 2 of the nonwoven fabric 1 are continuous fibers, an apprehension that the component fibers 2 of the nonwoven fabric 1 used as the wiper might partially fall off and these component fibers might stick again to the wall immediately after the dust and dirt have been wiped out from this wall. If the component fibers 2 are short fibers, on the other hand, a production rate can be improved with respect to the case in which the continuous fibers are used and a manufacturing cost of the nonwoven fabric 1 can be correspondingly reduced.

Figure 4:
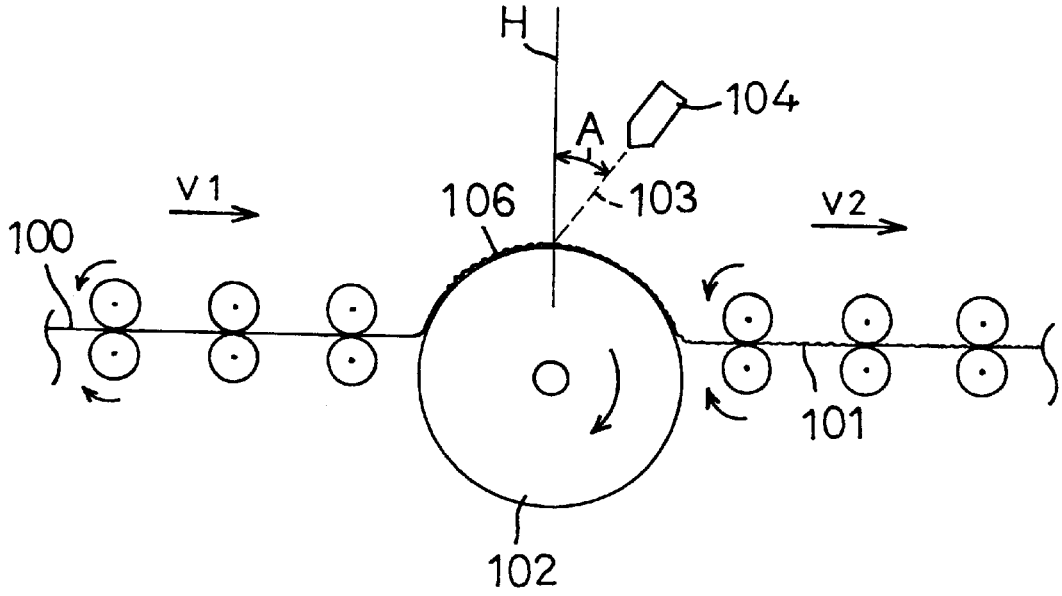
FIG. 4 is a diagram schematically illustrating the steps of the process for making the nonwoven fabric.

FIG. 4 is a diagram schematically illustrating a process for making the nonwoven fabric 1. Starting from the left hand in FIG. 4, a material web 100 is fed at a velocity $v_1$ from a comber or the like onto a drum-like support 102 rightward rotating. Thereupon, high pressure columnar water streams 103 are injected toward the web 100 from above. Specifically, the high pressure columnar water streams 103 are injected from a plurality of fine orifice nozzles 104 arranged above the drum-like support 102 on a line extending transversely of the web 100. These water streams rearrange the component fibers of the web 100 and entangle these component fibers to form a nonwoven fabric 101. The nonwoven fabric 101 is taken out at a velocity $v_2$ toward the right hand in FIG. 4 to be used as the nonwoven fabric 1 of FIG. 1. The transverse direction (i.e., CD) of this web 100 corresponds to the direction X of the nonwoven fabric 1 shown in FIG. 1 and the machine direction (i.e., MD) of the web 100 corresponds to the direction Y of the nonwoven fabric 1.

According to this process, the feed velocity $v_1$ is higher than the take-out velocity $v_2$ and these two velocities $v_1$, $v_2$ are previously adjusted on the basis of the take-out velocity $v_2$ so that: a feed velocity deceleration R (%)=$(v_1-v_2)/v_2\times 100$ may be maintained between 16~35%. Position at which the array of nozzles 104 should be mounted is selected so that the nozzles 104 may inject the columnar water streams 103 obliquely from the front toward the web 100 supported on the drum 102 at an angle A of 4~15° with respect to a perpendicular line H to the web 100 as illustrated in FIG. 4.

Consequently, the web 100 is formed immediately ahead of the columnar water streams 103 with a plurality of wrinkles 106 extending transversely of the web 100. At the same time, these wrinkles 106 are fixed by the columnar water streams 103 on the web 100 substantially as they are formed. These fixed wrinkles 106 are destined to form the bridge-like regions 8 of the nonwoven fabric 1. As well known to those skilled in the art, on the regions of the web 100 travelling in one direction which are immediately subjected to the columnar water streams 103, many of the component fibers constituting the web 100 are forcibly moved aside so as to form the low density regions 7 of the nonwoven fabric 1. The component fibers forcibly moved aside are accumulated between each pair of adjacent columnar water streams so as to form the high density regions 6. According to the process illustrated by FIG. 4, there is provided a suction mechanism (not illustrated) within the drum 102 and the columnar water streams are rapidly absorbed by this suction mechanism after the columnar water streams have acted upon the web 100.

According to this invention, the columnar water streams 103 are injected toward the web 100 obliquely from the front and thereby not only a plurality of wrinkles 106 can be formed on the web 100 but also the component fibers contained in the wrinkles 106 can be oriented transversely of the web 100. The bridge-like regions 8 obtained in this manner, distribute many fibers to the adjacent low density regions 7 and at least partially orient these fibers transversely of the web 100. In this manner, the tensile strength in the direction X of the nonwoven fabric 1 is improved and the stretchability in the direction X of the nonwoven fabric 1 is reduced.

EXAMPLE 1

A web comprising continuous fibers of polypropylene having a fineness of 0.5 deniers and a basis weight of 30 g/m$^2$ was fed into the production line as illustrated by FIG. 4 and a wrinkled nonwoven fabric as shown by FIG. 1 was obtained under conditions as will be described below. This nonwoven fabric had a tensile strength per a basis weight of 1 g and a width of 1 cm as follows:

Strength $S_{MD}$ in $MD$=36.7(g/cm)/(g/m$^2$)

Strength $S_{CD}$ in $CD$=27.3(g/cm)/(g/m$^2$)

$S_{CD}/S_{MD}$=0.74

(Conditions for Production)

Injection angle of columnar water streams (A) 7.2°

Feed velocity deceleration (R) 33%

EXAMPLE 2

The nonwoven fabric obtained under the same conditions for production as Example 1 except that the columnar water streams injection angle (A) was adjusted to 10.1° had a tensile strength as follow:

$S_{MD}$=33.0 (g/cm)/(g/m$^2$)

$S_{CD}$=25.8 (g/cm)/(g/m$^2$)

$S_{CD}/S_{MD}$=0.78

COMPARATIVE EXAMPLE 1

The web similar to that used in Example 1 was fed into the production line as illustrated by FIG. 4 and a nonwoven fabric having no wrinkle was obtained under conditions as will be described below. This nonwoven fabric had a tensile strength as follows:

$S_{MD}$=53.3(g/cm)/(g/m$^2$)

$S_{CD}$=25.8(g/cm)/(g/m$^2$)

$S_{CD}/S_{MD}$=0.48

(Conditions for Production)

Injection angle of columnar water streams (A) 0°

Feed velocity deceleration (R) 0%

COMPARATIVE EXAMPLE 2

A nonwoven fabric having no wrinkle was obtained under the conditions similar to those for Comparative Example 1 except that the columnar water streams were injected at an angle of 3.4° in the direction opposed to the web travelling direction. This nonwoven fabric had a tensile strength as follows:

$S_{MD}$=47.8(g/cm)/(g/m$^2$)

$S_{CD}$=24.2(g/cm)/(g/m$^2$)

$S_{CD}/S_{MD}$=0.51

Values of $S_{CD}/S_{MD}$ obtained in Examples 1, 2 and Comparative Examples 1, 2, respectively, indicate that the differential strength between in the MD and in the CD direction is smaller for the nonwoven fabric of this invention than for the nonwoven fabric obtained in Comparative Examples.

As will be apparent from the foregoing description, the nonwoven fabric according to this invention includes, in addition to the regions of high fibers surface density and the regions of low fibers surface density extending in parallel to each other in one direction, the bridge-like regions extending transversely thereof. Such an unique arrangement is effective to reduce the differential tensile strength and stretchability of the nonwoven fabric possibly depending on whether the nonwoven fabric is pulled in the one direction or in the direction intersecting the one direction and thereby to make the nonwoven fabric homogeneous.

What is claimed is:

1. A nonwoven fabric having first and second surfaces and formed by component fibers mechanically entangled between said first and second surfaces, regions of high fibers surface density and regions of low fibers surface density continuously or intermittently extend in parallel one to another in one direction so as to be alternatively arranged in a direction transversely of said one direction and to form undulations defined by crests corresponding to said regions of high fibers surface density and troughs corresponding to said regions of low fibers surface density; and said nonwoven fabric further including bridge regions each extending transversely of said one direction between each pair of adjacent ones of said regions of high fibers surface density and said regions of low fibers surface density, said bridge regions having a density higher than that of said regions of low fibers surface density.

2. The nonwoven fabric according to claim 1, wherein said regions of low fibers surface density have a width of 0.05~0.5 mm as measured transversely of said one direction.

3. The nonwoven fabric according to claim 1, wherein said component fibers partially extend transversely of said one direction.

4. The nonwoven fabric according to claim 1, wherein said component fibers are short fibers or continuous fibers.

5. The nonwoven fabric according to claim 1, wherein component fibers lying in the vicinity of an upper surface of the high density regions are oriented substantially in the one direction.

* * * * *